United States Patent [19]

Carr

[11] 4,433,336

[45] Feb. 21, 1984

[54] THREE-ELEMENT ANTENNA FORMED OF ORTHOGONAL LOOPS MOUNTED ON A MONOPOLE

[75] Inventor: Alan R. Carr, Boulder, Colo.

[73] Assignee: The United States of America as represented by the Secretary of Commerce, Washington, D.C.

[21] Appl. No.: 346,314

[22] Filed: Feb. 5, 1982

[51] Int. Cl.[3] ..... H01Q 7/00

[52] U.S. Cl. ..... 343/728; 343/742; 343/842

[58] Field of Search ..... 343/726, 728, 742, 842, 343/856

[56] References Cited

U.S. PATENT DOCUMENTS

| | | | |
|---|---|---|---|
| 3,588,905 | 6/1971 | Dunlavy | 343/856 |
| 3,882,506 | 5/1975 | Mori et al. | 343/728 |
| 4,397,041 | 8/1983 | Takeda et al. | 343/742 |

OTHER PUBLICATIONS

Barrick et al.; A Compact Transportable HF Radar System for Directional Coastal Wave Field Meas., Ocean Wave Climate, 1979, pp. 153–201.

*Primary Examiner*—Eli Lieberman
*Attorney, Agent, or Firm*—Eugene J. Pawlikowski; Alvin J. Englert

[57] ABSTRACT

A three-element directional/omnidirectional antenna adapted for use in both transmitting and receiving modes. Crossed loop antennas are mounted on top of a monopole whip antenna and are electrically coupled thereto. Each of the loop antennas consists of an outer larger primary loop and an inner secondary loop joined at its base to the primary loop. Both the primary and secondary loops are interrupted at their top ends opposite the point where they join the monopole antenna. A tuning capacitor is coupled between the two halves of each of the primary loops, while a coaxial antenna feeds the two secondary loops. The coaxial cables feeding the secondary loops pass through a dual ferrite choke disposed within the monopole antenna.

9 Claims, 2 Drawing Figures

14
12
11
13
20
19
15
41
40
16
17
18
42
22
21
23
24
35
30
27
25
29
28
26
TO SIGNAL SOURCE
/PROCESSOR
31
34
32
33
22
34
16
16

THREE-ELEMENT ANTENNA FORMED OF ORTHOGONAL LOOPS MOUNTED ON A MONOPOLE

BACKGROUND OF THE INVENTION

The present invention pertains to a multi-element antenna which, in a receiving mode, is capable of distinguishing the direction from which signals are received without being mechanically steered and, in a transmitting mode, is capable of being electrically steered or radiating uniformly.

A three-element directional antenna is described in an article, "A Compact Transportable HF Radar System for Directional Coastal Wave Field Measurements," Barrick et al. in *Ocean Wave Climate,* Earle et al., ed., Plenum Publishing Corporation, 1979, pp. 153–163, and which is adapted for use as a receiving antenna in a wave height measuring system. This system requires a receiving antenna which is capable of distinguishing the direction from which signals reflected from ocean waves are received. The antenna itself is composed of two crossed-loop antennas insulatingly mounted above a monopole antenna which in turn is fed against a four-element radial ground plane. The two crossed-loop antennas and the monopole antenna are connected to separate coaxial cables, and the output signals from the three coaxial cables processed and analyzed to determine wave height information based upon the Doppler spectrum of signals returned from the sea surface.

Although this antenna is capable of performing the desired function to some extent, it suffers from serious drawbacks. Most serious among these is the fact that the loop antennas are 21 dB less efficient than the monopole. The outputs from the loop antennas and the monopole must be balanced so that the three signal levels will be equivalent in magnitude, and hence so that the quantization error is the same for all three antennas, in order to perform the desired signal processing. Balancing the loop antennas and the monopole antenna effectively requires that the output signal from the monopole antenna be reduced by 21 dB. Unfortunately, by attenuating the output of the monopole antenna, the system signal-to-noise ratio is accordingly reduced. This drastically reduces the effective range of the system.

Also, quite importantly, this antenna cannot be used for transmitting; due to the use of sequential selection of the loop and monopole antennas, only receiving is possible.

A similar antenna is described in U.S. Pat. No. 3,882,506 issued May 6, 1975 to Mori et al. This antenna includes a whip or monopole antenna which extends through and above two crossed-loop antennas. The vertical monopole antenna is electrically insulated from the crossed loops.

That antenna too suffers from a number of drawbacks. First, the effective height of the vertical antenna is only that portion which extends above the crossed loops. Thus, it may be necessary to make the overall vertical height of the antenna quite high, which may be unacceptable for some applications. Secondly, the antenna of Mori et al. is useful only in receiving applications. This is due to the fact that the vertical antenna must pass through the high impedance (and hence high voltage in the transmitting mode) portion of the loop antennas, specifically, the gap at the top of the loop antennas. Thus, high voltage flashover would likely occur if the antenna were used in a transmitting mode.

Moreover, the transmitting efficiency of the loops is quite low.

U.S. Pat. No. 3,588,905 issued June 28, 1971 to Dunlavey describes a wide range tunable transmitting loop antenna composed of a single turn tuned primary loop fed by a small single turn untuned secondary. By properly adjusting the ratio between the diameters of the primary and secondary loops, an accurate impedance match to a low-impedance cable is achievable over a wide tuning range. Also, high efficiencies are attainable with relatively small sizes. For instance, a minimum efficiency of 30 percent is attainable for an overall antenna diameter of about five feet for a frequency range of 3 to 15 megahertz.

However, the antenna described by Dunlavey requires a mechanical rotator for steering. Moreover, this antenna cannot radiate omnidirectionally.

SUMMARY OF THE INVENTION

Thus, it is an object of the present invention to provide an antenna which is electrically steerable or which can be utilized to determine the direction from which signals are received without the use of a mechanical rotator and which has a high efficiency.

It is further an object of the present invention to provide such an antenna which has a compact overall size.

It is yet another object of the invention to provide such an antenna which is usable in both receiving and transmitting modes and which is selectively directional or omnidirectional.

In accordance with these and other objects of the invention, there is provided an antenna including a vertically oriented monopole antenna atop which are conductively connected two loop antennas oriented orthogonally with respect to one another and having their axes oriented perpendicular to the axis of the monopole antenna. By "axis" of a loop antenna is meant an imaginary line orthogonal to and passing through the center of the plane of the loop or loops of the antenna. The monopole antenna is formed of a conductive tube through which pass coaxial cables which are coupled to respective ones of the loop antennas.

Each of the loop antennas is composed of a larger primary loop and a smaller secondary loop arranged in the same plane as the primary loop. The primary loop of each of the two loop antennas is connected electrically at its lowermost point to the top of the monopole antenna. Each primary loop is interrupted at its top end opposite the upper end of the monopole antenna and a tuning capacitor is coupled between the two sides of the primary loop. The primary and secondary or coupling loops are both formed from hollow tubes. As in the case of the primary loops, the secondary loops are interrupted at their top ends opposite the top end of the monopole antenna. The coaxial cable coupled to each secondary loop passes through one side thereof. At the interruption in the secondary loop, the center conductor of the coaxial cable is connected to one side of the secondary loop while the ground or outer conductor is connected to the other. In accordance with the invention, the two primary loops, the two secondary loops and the upper end of the monopole antenna are all electrically connected at one point.

Preferably, the bottom of the monopole antenna is mounted upon an insulator base and a ground plane provided under the monopole antenna. A dual ferrite choke is placed within the monopole antenna through which the loop coaxial cables pass. The purpose of this ferrite choke is to isolate the cables feeding the loop antennas from the monopole in order that they do not short circuit the monopole antenna. A third coaxial cable is coupled to the monopole antenna through a second ferrite choke and matching circuit.

DESCRIPTION OF THE PREFERRED EMBODIMENTS

Figures 1, 2:
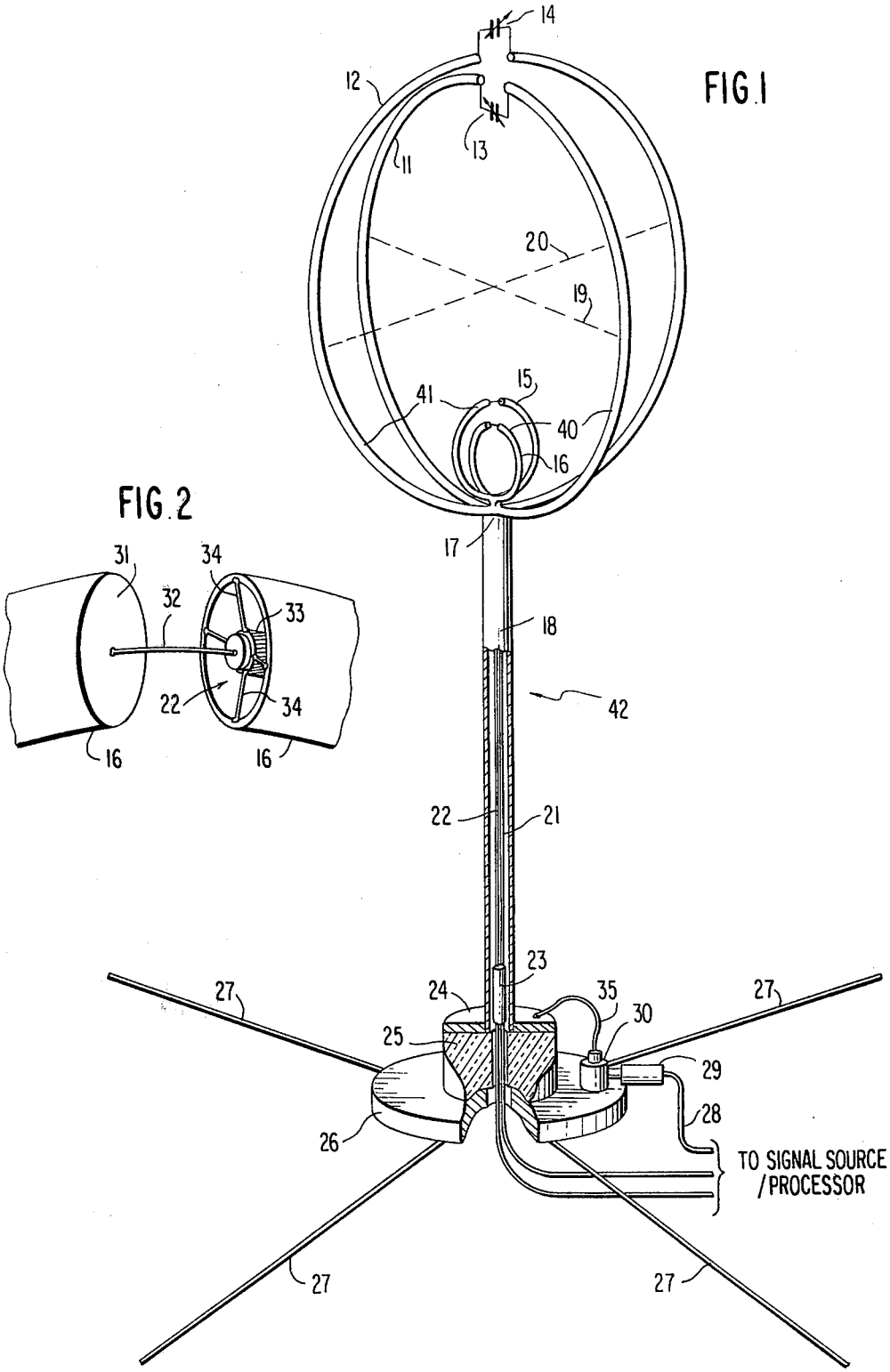
FIG. 1 is a partially cut-away view of a three-element antenna constructed in accordance with the teachings of the invention.
FIG. 2 shows details of the construction of the upper portions of secondary loops utilized in the antenna shown in FIG. 1.

Referring now to FIG. 1, there is shown therein a partially cut-away view of an antenna of the invention. This antenna is composed of a vertically oriented monopole antenna 42 which is supported at its lower end upon an insulator 25. At the upper end of the monopole antenna 42 are mounted and electrically coupled two loop antennas 40 and 41.

Each of the loop antennas 40 and 41 in turn is composed of two loops arranged in the same plane, a primary loop and a secondary loop positioned at a lower portion of the primary loop. Specifically, the loop antenna 40 includes a primary loop 11 and a secondary loop 16 while the loop antenna 41 includes a primary loop 12 and a secondary loop 15. Each of the loops 11, 12, 15 and 16 is formed of a curved conductive tube with all of the tubes being joined at a base portion 17. The loops are shown here as being circular although they need not have precisely that shape. For instance, the loops may have a hexagonal or octagonal shape. Preferably, the circumference of each of the primary loops is less than one quarter wavelength at the frequency at which the antenna is operated while the effective height of the monopole antenna is less than one-quarter wavelength. In the antenna of the invention, the "effective height" of the monopole antenna includes both the physical height of the monopole antenna 42 and the height of the loop antennas 40 and 41, as the loop antennas electrically form a part of a composite monopole antenna. In a preferred embodiment which is suitable for operation in the high frequency bands, the primary loops 11 and 12 can be fabricated from 1½ inch diameter copper tubing while the secondary or coupling loops 15 and 16 can be made with ½ inch diameter copper tubing.

Each of the loops 11, 12, 15 and 16 is interrupted at a top portion thereof. Tuning capacitors 13 and 14 are coupled between the two loop halves of primary loops 11 and 12, respectively. Two coaxial cables 21 and 22 pass through holes in a conductive base plate 26 and a supporting insulator 25 and pass through the tubular monopole antenna 18 and then through one-half of corresponding secondary loops 15 and 16. As shown in detail in the diagram of FIG. 2 (which shows the loop 16 although the identical construction is used for the loop 15), the coaxial cable 22 terminates at the end of one of the halves of the loop 16. The center conductor 32 of the coaxial cable is connected electrically to a conductive end face 31 affixed to the end of the other half of the loop 16. The outer or ground conductor 33 of the coaxial cable 22 is connected through supporting wires 34 to the half of the loop 16 through which the coaxial cable 22 passes. Preferably, the wires 34 hold the end of the coaxial cable 22 centered at the end of the loop 16.

A support system such as plastic tensioning straps 19 and 20 may be used to support the loops 11 and 12. These are shown as dashed lines and not in detail as any suitable non-conductive support structure may be used.

The coaxial cables 21 and 22 which connect to the secondary loops 15 and 16 pass through a dual ferrite choke 23 which is located within a conductive tubular member 18 from which the monopole antenna 42 is fabricated. The purpose of the dual ferrite choke 23 is to prevent the coaxial cables 21 and 22 from short-circuiting the monopole antenna.

A third coaxial cable 28 is coupled to the base of the monopole antenna 42 through a ferrite choke 29 and a matching circuit 30. The ferrite choke 29 and the matching circuit 30 may be of a standard design with parameters chosen in accordance the frequency at which the antenna is to be operated. A wire 35 makes connection between the matching circuit 30 and the base of the monopole antenna tubular member 18.

An aluminum base plate 26 is joined to the bottom of the insulator 25. Four ground plane reflectors 27 are connected to the base plate 26 in a standard arrangement.

In operation, the antenna can be operated as an omnidirectional antenna in either the receiving or transmitting mode by receiving a signal from or applying a signal to, the coaxial cable 28 which is coupled to the monopole antenna 42. If only the cable 28 is active, the loop antennas 40 and 41 together produce a substantially uniform pattern because the current distributions in the two loop antennas 40 and 41 are identical. To receive or transmit in a directional mode, one or the other or both of the loop antennas 40 and 41 is activated by receiving signals from, or applying signals to, the appropriate one or both of the two coaxial cables 21 and 22 with an amplitude and phase relationship determined so as to direct the antenna in the desired direction. Moreover, signals can be received from, or supplied to each of the loop antennas 40 and 41 and the monopole antenna 42 to achieve a particular receiving or radiation pattern. Further, the antenna of the present invention is advantageous in that the total height of the antenna for omnidirectional operation is the same as the height of the primary loops 11 and 12 and the height of the monopole antenna 42.

Another advantage of electrically joining each of the loops 11, 12, 15 and 16 at the top of the monopole antenna tube 18, besides the reduced overall height of the antenna, is the fact that no insulating section is required between the base of the loop antennas 40 and 41 and the top of the monopole antenna 42. Thus, in the transmitting mode, there is no danger of arcing between the loop antennas 40 and 41 and the monopole antenna 42.

A still further advantage of the antenna of the invention is that the power transfer efficiency from the loop antennas 40 and 41 constructed as described above is higher than what was obtainable with prior art arrangements. With the antenna of the invention, it is not necessary to attenuate the signal to or from the monopole antenna in order to achieve balance between it and the loop antennas.

A yet further advantage of the invention is that, due to the coaxial arrangement of the loop antennas and monopole antenna, receiving and transmitting on the same frequency at the same location can be carried out simultaneously. For instance, in an HF radar application, a transmitting signal can be applied to the monopole antenna to be radiated omnidirectionally while directional reception is carried out with the loop antennas.

Thus, in summary, the antenna of the invention is compact and efficient, and it does not suffer from the arcing problems in the transmit mode as were present in prior art designs.

This completes the description of the preferred embodiments of the invention. Although preferred embodiments have been described, it is believed that numerous modifications and alterations thereto would be apparent to one having ordinary skill in the art without departing from the spirit and scope of the invention.

I claim:

1. A three-element antenna comprising:

a monopole antenna; and first and second loop antennas mounted on and electrically coupled to one end of said monopole antenna, said loop antennas having axes orthogonal to one another and to a longitudinal axis of said monopole antenna, each of said loop antennas comprising an outer primary loop and a smaller inner secondary loop disposed in the same plane as that of said primary loop and electrically coupled thereto.

2. The antenna of claim 1 wherein each of said primary loops and each of said secondary loops are interrupted at a side thereof opposite said end of said monopole antenna, and further comprising first and second tuning capacitors coupled between halves of respective ones of said outer loops, and first and second coaxial cables coupled to respective ones of said inner loops.

3. The antenna of claim 2 wherein each of said coaxial cables has a center conductor coupled to the corresponding inner loop on one side of the interruption in said inner loop and an outer conductor coupled to the other half of said inner loop at the other side of said interruption.

4. The antenna of claim 3 wherein said monopole antenna comprises a conductive tubular member.

5. The antenna of claim 4 further comprising a dual ferrite choke, said dual ferrite choke being located within said conductive tubular member, and said first and second coaxial cables passing through said dual ferrite choke.

6. The antenna of claim 5 further comprising ground plane means disposed below said monopole antenna.

7. The antenna of claim 5 further comprising a third coaxial cable, a second ferrite choke and a matching circuit, said third coaxial cable being coupled through said second ferrite choke and said matching circuit to a lower end of said monopole antenna.

8. The antenna of claim 5 wherein each of said loops is composed of a hollow tube, said inner loops having a smaller cross sectional diameter than that of said outer loops.

9. The antenna of claim 5 wherein the length of said monopole antenna is less than one-quarter wavelength at the frequency at which said antenna is operated, and wherein the circumference of said outer loops is less than one quarter of said wavelength at which said antenna is operated.

* * * * *